US006418986B1

(12) United States Patent
Gabriele

(10) Patent No.: US 6,418,986 B1
(45) Date of Patent: Jul. 16, 2002

(54) NOZZLE APPARATUS, A DEVICE FOR INSERTING MATERIALS INTO A CONTAINER USING SUCH NOZZLE APPARATUS, AND A CONTAINER CONTAINING MATERIALS INSERTED THEREIN WITH THE USE OF SUCH DEVICE

(75) Inventor: Joseph Anthony Gabriele, Whippany, NJ (US)

(73) Assignee: SmithKline Beecham Corporation, Philadelphia, PA (US)

( * ) Notice: Subject to any disclaimer, the term of this patent is extended or adjusted under 35 U.S.C. 154(b) by 0 days.

(21) Appl. No.: 09/970,492

(22) Filed: Oct. 4, 2001

Related U.S. Application Data

(63) Continuation of application No. 08/886,717, filed on Jul. 1, 1997, now abandoned.

(51) Int. Cl.[7] ..... B65B 1/04; B65B 3/04; B67C 3/02

(52) U.S. Cl. ..... 141/100; 141/99; 141/263; 141/275; 141/312; 141/313; 141/374; 222/575; 239/398; 239/416.5; 239/423; 239/549; 239/601

(58) Field of Search ..... 141/100, 105, 141/263, 275, 311 R, 312, 313, 317, 319, 320, 321, 374; 222/94; 239/11, 418, 429, 430–434, 434.5

(56) References Cited

U.S. PATENT DOCUMENTS

| | | | |
|---|---|---|---|
| 1,676,734 | A | 7/1928 | Hopkins |
| 3,559,700 | A | 2/1971 | Erickson |
| 3,952,782 | A | 4/1976 | Mannara |
| 4,015,644 | A | 4/1977 | Kinney |
| 4,966,205 | A | 10/1990 | Tanaka |
| 5,590,818 | A | 1/1997 | Raba et al. |

FOREIGN PATENT DOCUMENTS

| | | |
|---|---|---|
| GB | 962757 | 7/1964 |
| GB | 2 142 611 A | 1/1985 |

*Primary Examiner*—Timothy L. Maust
(74) *Attorney, Agent, or Firm*—Frommer Lawrence & Haug LLP; Dennis M. Smid

(57) ABSTRACT

A nozzle for use with an apparatus for inserting toothpaste having a plurality of materials into a toothpaste container. The nozzle includes a first hollow member for receiving a first material, and a second hollow member arranged inside the first hollow member for receiving a second material. The first and second hollow members enable the first and second materials to be inserted into the toothpaste container such that. one of the first and second materials is arranged inside the other of the first and second materials when the toothpaste is dispensed from the toothpaste container.

13 Claims, 6 Drawing Sheets

NOZZLE APPARATUS, A DEVICE FOR INSERTING MATERIALS INTO A CONTAINER USING SUCH NOZZLE APPARATUS, AND A CONTAINER CONTAINING MATERIALS INSERTED THEREIN WITH THE USE OF SUCH DEVICE

The present invention is a continuation of application Ser. No. 08/886,717 filed Jul. 1, 1997, now abandoned.

BACKGROUND OF THE INVENTION

The present invention relates to a nozzle apparatus and, more particularly, to such apparatus for use with a device for inserting toothpaste into a toothpaste container. The present invention further relates to a toothpaste inserting device having the present nozzle apparatus and to a container having toothpaste materials which were inserted therein by such toothpaste inserting device.

Toothpaste is normally inserted into toothpaste containers by use of a filling or manifold-type machine (such as that manufactured by the Norden Packaging Company or the IWK Packaging Machinery Inc., Fairfield, N.J., U.S.A.). That is, toothpaste material may be supplied to the manifold-type machine by use of hoses or the like and fed therethrough to a nozzle, whereupon the toothpaste material may be inserted into a toothpaste container. Such toothpaste container may be a pump-type container, a tube-type container, or the like.

The toothpaste may comprise a single-colored material or a plurality of different colored materials. In the latter situation, the materials may be inserted into the container so as to have a predetermined arrangement therein such that, upon dispensing the toothpaste from the container (such as by operating the pump of a pump-type container), the toothpaste materials may have a desired appearance. Such predetermined arrangement of materials within a container may be accomplished by use of the nozzle and, in particular, the internal configuration thereof. As an example, the nozzle may be configured as described in U.S. Pat. No. 5,590,818, which is hereby incorporated by reference, wherein the inner portion of the nozzle may have a center channel, a first plurality of side channels which are in communication with the center channel, and a second plurality of side channels so that toothpaste materials having different colors may be deposited in different segments within a container such that, upon dispensing the toothpaste from the container, the toothpaste has a striped appearance.

However, as is to be appreciated, it may be desirable to provide other arrangements of toothpaste material within a container such that the toothpaste has other appearances upon being dispensed from the container.

OBJECTS AND SUMMARY OF THE INVENTION

An object of the present invention is to provide a nozzle apparatus for use with a device for inserting toothpaste materials into a toothpaste container so as to have a predetermined arrangement therein such that the materials have a desired appearance, which is different from a striped appearance, when the toothpaste is dispensed from the toothpaste container.

More specifically, it is an object of the present invention is to provide a nozzle apparatus for use with a device for inserting toothpaste having first and second materials into a toothpaste container such that one of the first and second material is arranged inside the other of the first and second materials when the toothpaste is dispensed from the toothpaste container.

Another object of the present invention is to provide a toothpaste container having first and second toothpaste materials contained therein wherein one of the first and second material is arranged,inside the other such that the inner one of the first and second toothpaste materials is also inside the other when the toothpaste materials are dispensed from the container.

In accordance with an aspect of the present invention, a nozzle apparatus for use with a device for inserting toothpaste a having a plurality of materials into a toothpaste container is provided. The apparatus comprises a first hollow member for receiving a first material, and a second hollow member arranged inside the first hollow member for receiving a second material. The first and second hollow members enable the first and second materials to be inserted into the toothpaste container such that one of the first and second material is arranged inside the other of the first and second materials. when the toothpaste is dispensed from the toothpaste container.

Other objects, features, and advantages according to the present invention will be apparent from the following detailed description of illustrated embodiments when read in conjunction with the accompanying drawings in which corresponding components are identified by the same reference numerals.

Figure 5A:
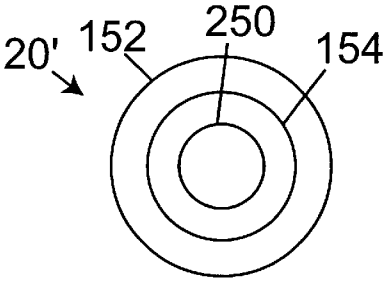
Figure 5B:
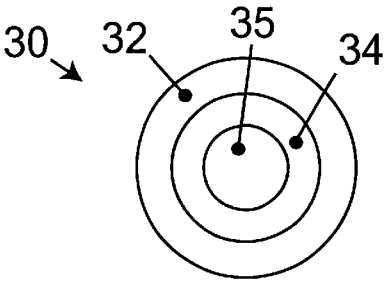
Figure 5C:
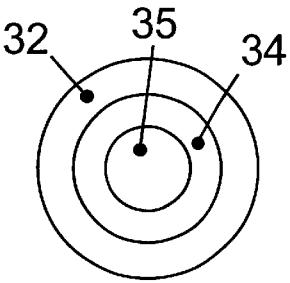
Figure 6A:
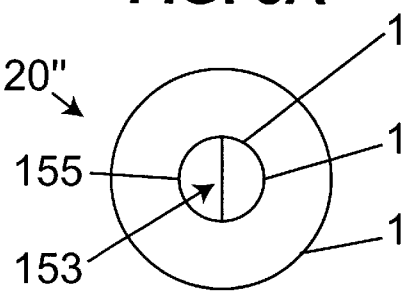
Figure 6B:
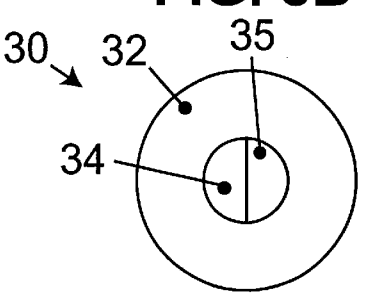
Figure 6C:
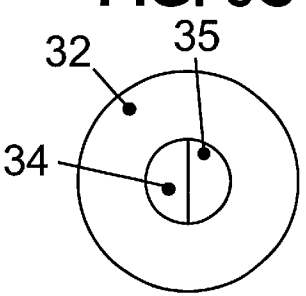
Figure 7A:
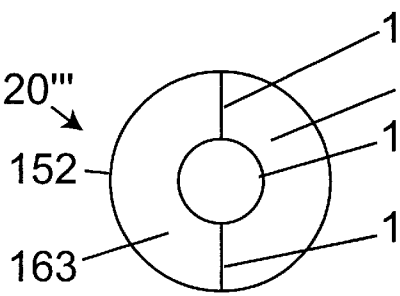
Figure 7B:
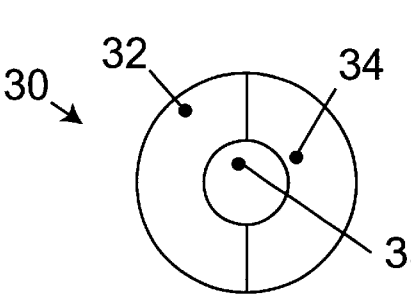
Figure 7C:
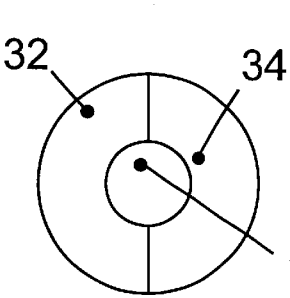

FIG. SA is a cross-sectional view of a nozzle according to an embodiment of the present invention;

FIG. 5B is a diagram of a cross-sectional area of a toothpaste container according to another embodiment of the present invention;

FIG. 5C is a diagram of a cross-sectional area of the toothpaste after being dispensed from the toothpaste container of FIG. 5A;

FIG. 6A is a cross-sectional view of a nozzle according to an embodiment of the present invention;

FIG. 6B is a diagram of a cross-sectional area of a toothpaste container according to another embodiment of the present invention;

FIG. 6C is a diagram of a cross-sectional area of the toothpaste after being dispensed from the toothpaste container of FIG. 6A;

FIG. 7A is a cross-sectional view of a nozzle according to an embodiment of the present invention;

FIG. 7B is a diagram of a cross-sectional area of a toothpaste container according to another embodiment of the present invention; and FIG. 7C is a diagram of a cross-sectional area of the toothpaste after being dispensed from the toothpaste container of FIG. 7A.

DESCRIPTION OF THE PREFERRED EMBODIMENTS

The preferred embodiments of the present invention will now be explained with reference to the accompanying drawings.

Figure 1:
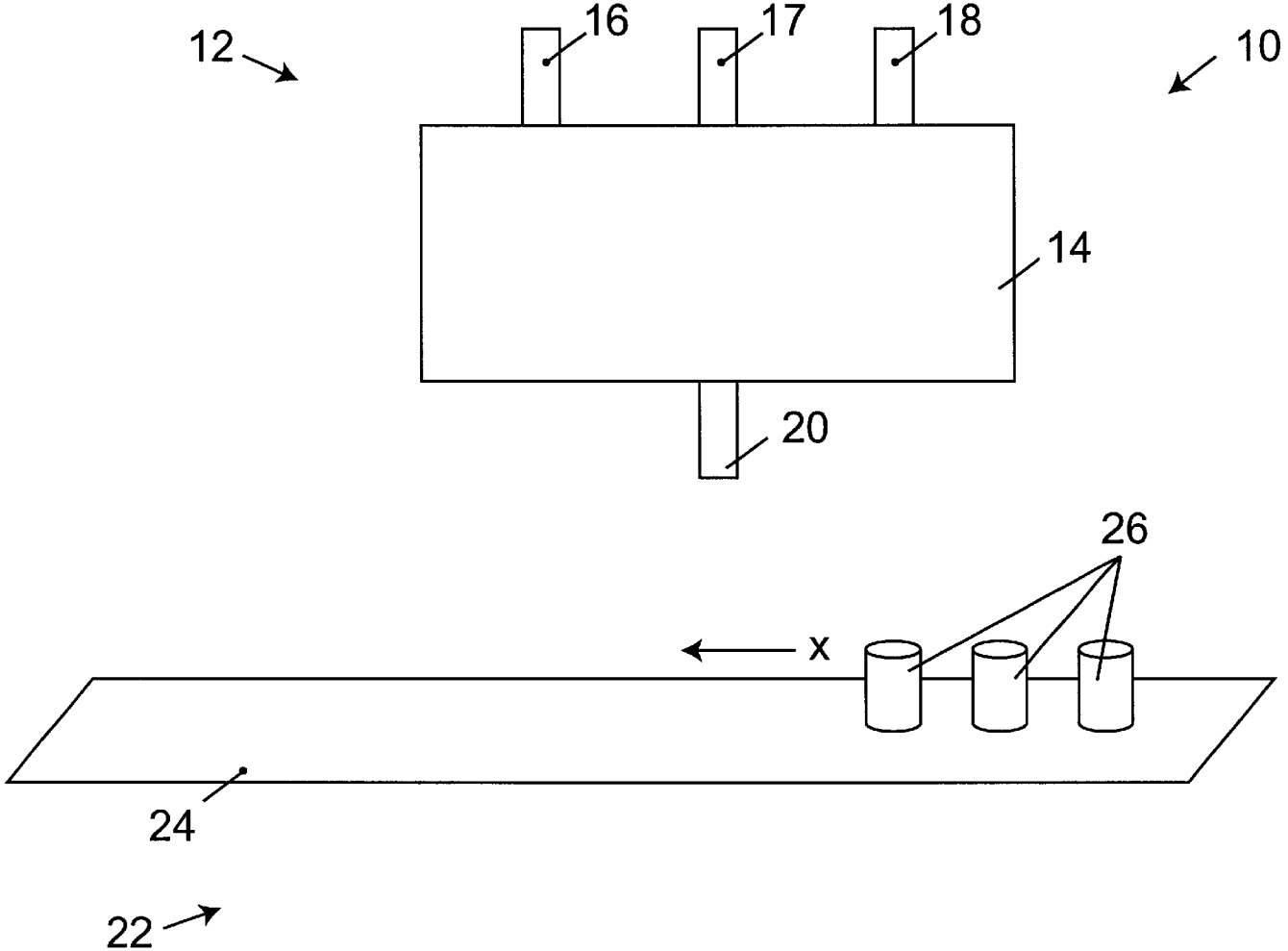
FIG. 1 is a diagram of an apparatus having a nozzle for inserting toothpaste into a toothpaste container according to an embodiment of the present invention.

FIG. 1 illustrates an apparatus 10 adapted for inserting toothpaste into toothpaste containers. As shown therein, such apparatus includes a filling device 12 having a manifold-type device 14 (such as that manufactured by the IWK Packaging Machinery Inc. or the Norden Packaging Company) to which are coupled a plurality of hoses 16–18 and a nozzle 20. The manifold-type device 14 may receive a plurality of toothpaste materials from storage containers (not shown) through the hoses 16–18. For example, a paste material having a first color (such as white) may be supplied through the hoses 16 and 18, and a gel material having a second color (such as red) may be supplied through the hose 17. Such received materials may be supplied through the filling device 12 to the nozzle 20. The apparatus 10 further includes a conveyor assembly 22 having a conveyor belt 24 which is; movably driven by a drive assembly (not shown) for transporting a plurality of containers 26, such as those utilized for pump-type containers.

Figure 2A:
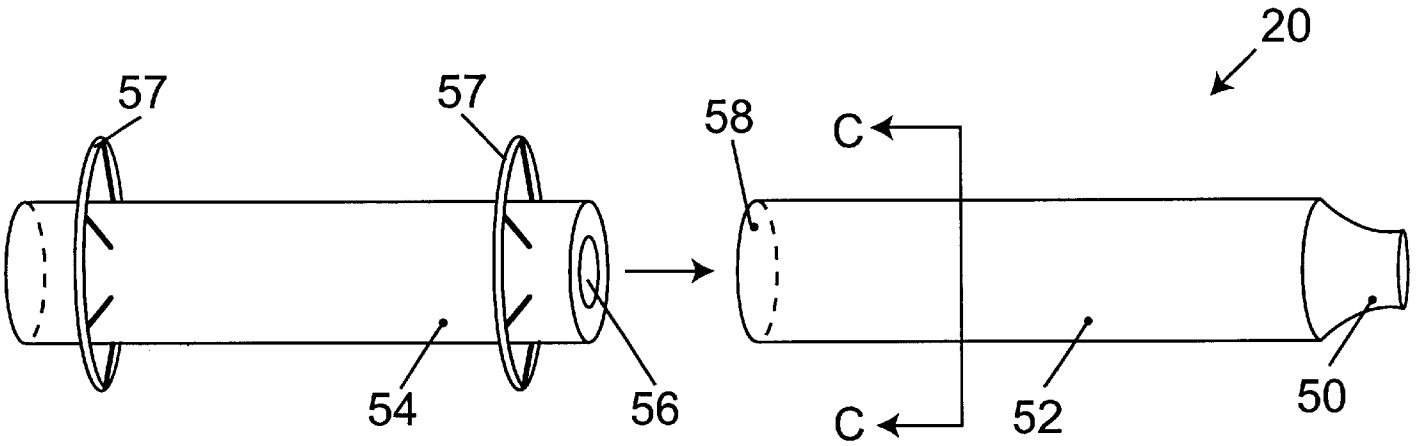
FIG. 2A is a diagram of the nozzle of the device of FIG. 1.

The nozzle 20 is adapted to cause the toothpaste materials to be inserted into the containers 26 in a predetermined manner such that the toothpaste materials have a desired appearance upon being dispensed from the containers. More specifically, the nozzle 20 may be configured so as cause the red gel material to be arranged inside the white paste material when the toothpaste is dispensed from the toothpaste container 26. In such configuration, the nozzle 20 may include an outer hollow or tube-shaped member 52, an inner hollow or tube-shaped member 54 arranged within the outer tube-shaped member, and an end portion 50, as shown in FIG. 2A. The inner tube member 54 has a hollow center portion 56 which is adapted to allow a material to pass through. The outer tube member has an opening 58 after the inner tube member is inserted therein which is adapted to allow a material to pass through. Further, one or more spacers 57 may be arranged on an outer surface of the inner tube member 54 so as to facilitate the installation of the inner tube member into the outer tube member 52 and/or to maintain the inner tube member at a proper alignment within the outer tube member.

Figure 2B:
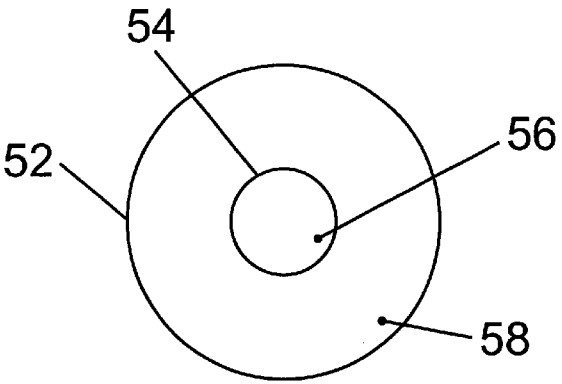
FIG. 2B is a cross-sectional view along section C—C of the nozzle of FIG. 2A.

A cross-section of the assembled nozzle 20 may be basically considered two concentric circles as, for example, illustrated in FIG. 2B. (As is to be appreciated, in FIG. 2B, the thicknesses of the outer and inner tube members are merely indicated by single respective lines.)

The nozzle 20 may be modified as illustrated in FIG. 3. More specifically, as shown in FIG. 3A, the nozzle generally includes an outer member 152, an inner member 154 arranged within the outer member, and an end portion 150. The outer member 152 may include an upper portion 164 having an O-ring 165 arranged in a groove, for enabling a seal to be provided between the nozzle 20 and the manifold-type device 14. The outer member 152 has an opening 158 after the inner member is inserted therein which is adapted to allow a material to pass through. As shown in FIG. 3B, the inner member 154 may have a first portion 170 and a second portion 172 which has an outer diameter smaller than that of the first portion and may have a hollow center portion 156 which extends through the first and second portions and is adapted to allow a material to pass through. The inner member 154 may include one or more spacers 157 in a manner similar to that of the spacers 57 of the nozzle of FIG. 2A. The inner member 154 may further include an upper portion 168 having an O-ring 169 arranged in a groove which may provide a seal between the inner member 154 and the manifold-type device 14. FIG. 3C illustrates a partial view of a lower portion of the nozzle 20.

Figure 3C:
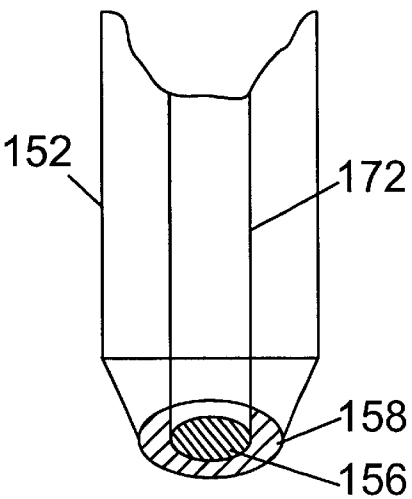
FIGS. 3A, 3B, and 3C are diagrams of a modified nozzle.
Figure 3B:
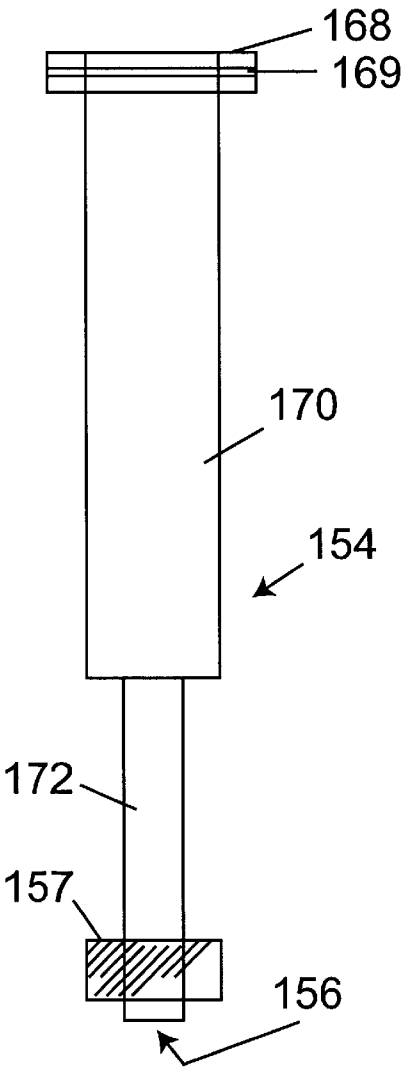
Figure 3A:
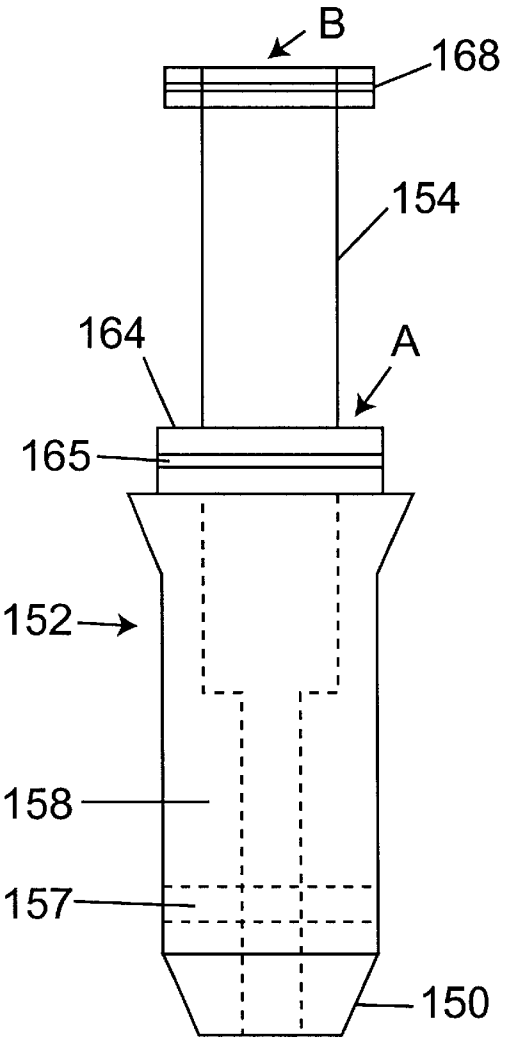
Figure 3D:
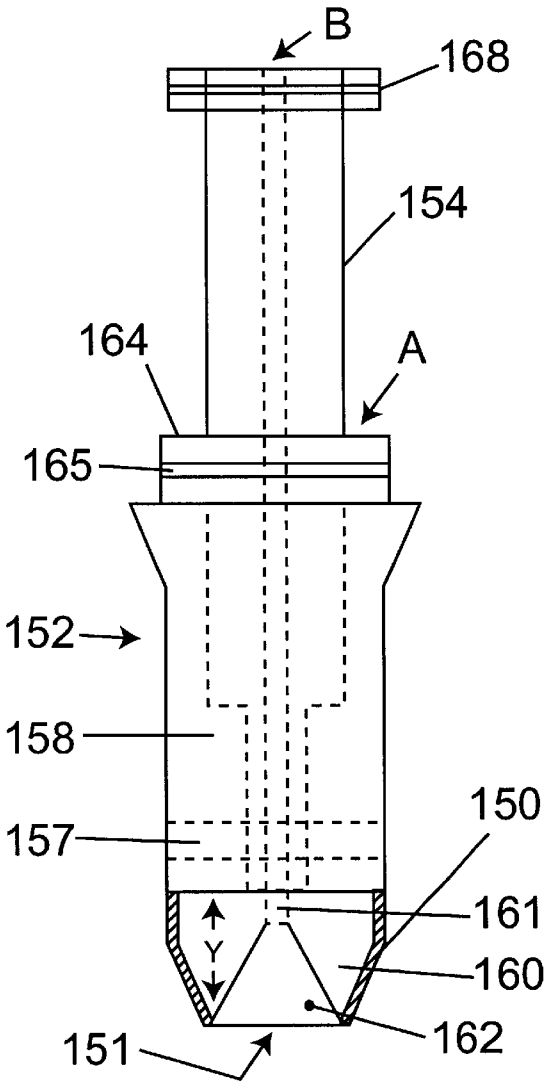
FIG. 3D is a diagram of a nozzle having a shut-off mechanism.

As shown in FIG. 3D, the nozzle 20 may also include a shut-off mechanism 160 which is adapted to stop the flow of material from the-nozzle. For example, the shut-off mechanism 160 may include a shaft member 161 and a close member 162 coupled at one end to the shaft member and having at the other end a portion at least as large as an opening 151 of the end portion 150. The shaft member 161 may be arranged so as to extend through the opening 156 of the inner member 154. The shut-off mechanism may be movable in an upward/downward direction Y in accordance with the insertion of toothpaste material into each container 26. That is, the shut-off mechanism 160 may be moved so as to be placed in an upward position during a filling operation to enable material to flow through the end portion 150 into a respective one of the containers 26 and, upon completion thereof, may be moved so as to be placed in a downward position to prevent toothpaste material from flowing into the respective container.

Figures 4A, 4B, 4C:
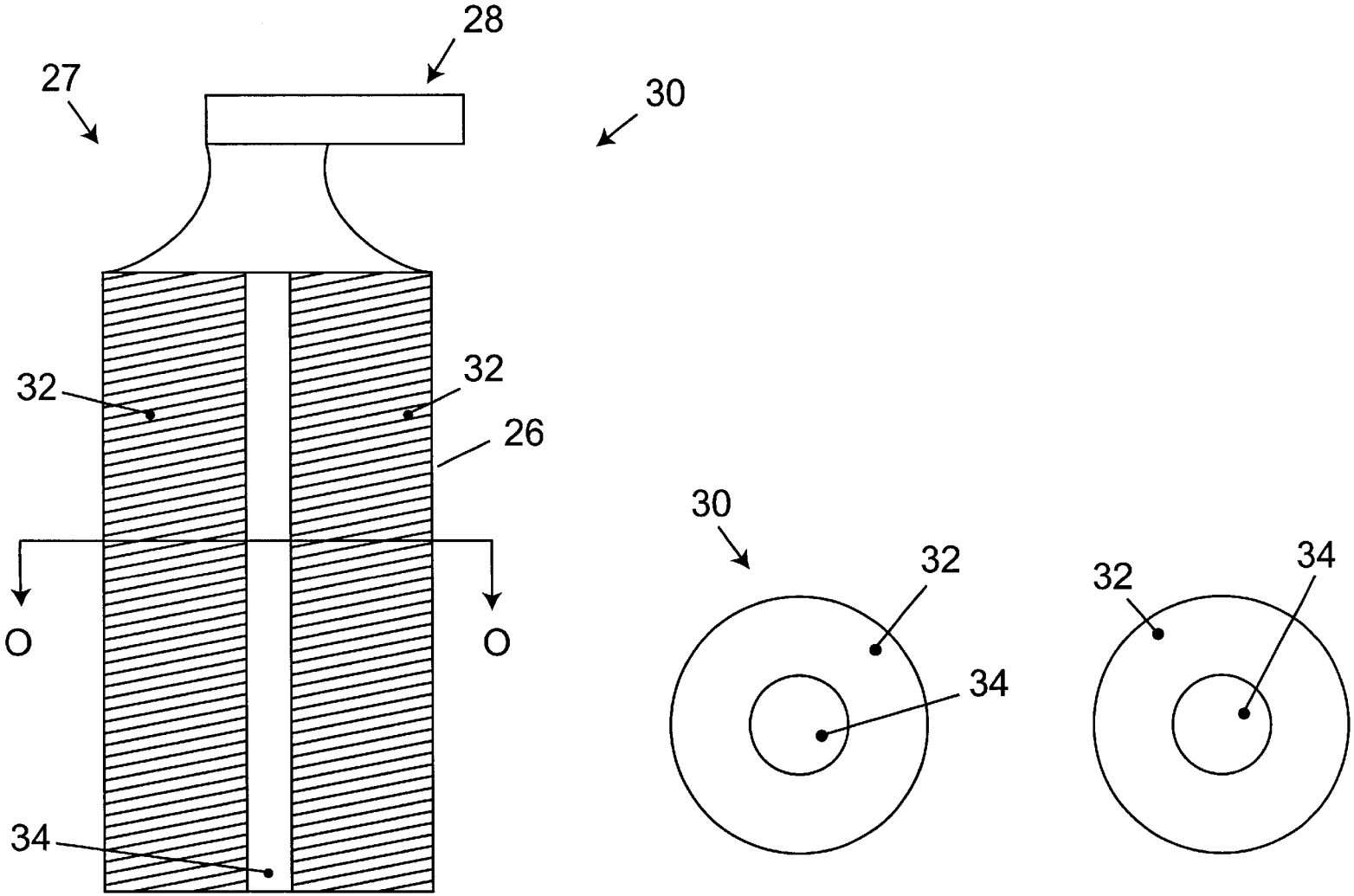
FIG. 4A is diagram of a toothpaste container having a plurality of materials contained therein according to an embodiment of the present invention.
FIG. 4B is diagram of a cross-sectional view along section D—D of the toothpaste container of FIG. 4A.
FIG. 4C is a diagram of a cross-sectional area of the toothpaste after being dispensed from the toothpaste container of FIGS. 4A and 4B.

In operation, the white paste material and the red gel material are respectively supplied from storage containers through the hoses 16,18 and 17 to the manifold-type device 14, wherein such materials are supplied therethrough to the nozzle 20. In particular, the white paste material is supplied into the opening 158 of the outer member 152 as indicated by an arrow A and the red gel material is supplied into the opening 156 of the inner member 154 as indicated by an arrow B in FIG. 3A. The containers 26 are moved along the conveyor belt 24 such that one of the containers is positioned in-line with the nozzle 20. As a result, the white paste material and the red gel material may be inserted into the respective container 26 in a predetermined manner. That is, as illustrated in FIG. 4A, white paste material 32 and red gel material 34 may be arranged within a container 26 such that the red gel material is located in an inner or center portion and the white paste material is located an outer portion thereof. As such, the red gel material is located inside the white paste material. Such arrangement of the white paste and red gel materials may have a substantially concentric arrangement as shown in FIG. 4B.

After the toothpaste materials have been inserted into a respective container 26, the conveyor belt 24 may move in an X-direction as indicated in FIG. 1 so as to align another one of the containers 26 with the nozzle 20, whereupon toothpaste materials are inserted into such container in a similar manner. Thereafter, a top portion 27 having a pump mechanism 28 may be assembled onto each of the containers 26 filled with toothpaste materials so as to form a filled toothpaste container 30, as shown in FIG. 4A.

Upon dispensing the toothpaste material from the toothpaste container 30 by use of the pump mechanism 28, the toothpaste material has a predetermined appearance. That is, in such dispensed toothpaste material, the red gel material 34 may be located in an inner or center portion and the white paste material 32 may be located at an outer portion so as to basically surround,the red gel material. In other words, the red gel material is located inside the white paste material. As a result, the dispensed toothpaste material may have a substantially concentric cross-sectional arrangement as shown in FIG. 4C which may be similar to the concentric cross-sectional arrangement of the red gel and white paste materials inside the container 30 as shown in FIG. 4B.

Although the present nozzle was described as having one inner member and an outer member which basically have a cross section of two concentric circles as illustrated in FIG. 2B which may cause the red gel material to be arranged inside the white paste material both inside the container 30 and when dispensed therefrom (as indicated in FIGS. 4B and 4C), the present nozzle is not so limited. That is, the present nozzle may have other configurations so as to provide other arrangements wherein at least one toothpaste material is arranged inside another toothpaste material. Examples of other such configurations will now be described with reference to FIGS. 5–7.

With regard to FIG. 5, a nozzle 20' is provided which is substantially similar to that of FIG. 3 except that it includes a second inner member 250 arranged inside the first inner member 154, as shown in FIG. 5A. In this arrangement, three different materials may be utilized. As an example, a white paste material 32 may be inserted into the outer member 152, a red gel material 34 may be inserted into the first inner member 154, and a blue gel material 35 may be inserted into the second inner member 250, in a manner similar to that previously described. Such nozzle 20'. may cause the white paste material 32, the red gel material 34, and the blue gel material 35 to be arranged inside the container 30 so as to have a cross-section therein as shown in FIG. 5B and to have a cross-section when dispense,d therefrom as shown in FIG. 5C.

With regard to FIG. 6, a nozzle 20" is provided which is substantially similar to that of FIG. 3 except that the inner member 154 may include a dividing member 153 as shown in FIG. 6A. Such dividing member divides the opening 156 of the inner member 154 into two portions 155 and 159. In this situation, three different materials may be utilized. As an example, the white paste material 32 may be inserted into the outer member 152, the red gel material 34 may be inserted into the left portion 155, and the blue gel material 35 may be inserted into the right portion 159, in a manner similar to that previously described. Such nozzle 20" may cause the white paste material 32, the red gel material 34, and the blue gel material 35 to be arranged inside the container 30 so as to have a cross-section therein as shown in° FIG. 6B and to have a cross-section when dispensed therefrom as shown in FIG. 6C.

With regard to FIG. 7, a nozzle 20'" is provided which is substantially similar to that of FIG. 3 except that the outer member 152 may include a dividing member 161 as shown in FIG. 7A. Such dividing member divides the opening 158 of the outer member 152 into two portions 163 and 165. In this situation, three different materials may be utilized. As an example, the white paste material 32 may be inserted into the left portion 163, the red gel material 34 may be inserted into the right portion 165, and the blue gel material 35 may be inserted into the inner member 154, in a manner similar to that previously described. Such nozzle 20"' may cause the white paste material 32, the red gel material 34, and the blue gel material 35 to be arranged inside the container 30 so as to have a cross-section therein as shown in FIG. 7B and to have a cross-section when dispensed therefrom as shown in FIG. 7C.

Although in describing the present invention specific colors were utilized for the various toothpaste materials, the present invention is not so limited. Instead, any other desired colors may be used for such materials.

Further, although in describing the present invention specific shapes of the inner and outer members were utilized, the present invention is not so limited. Instead, such members may have any desired shapes, such as oval, rectangular, square, and so forth;

Furthermore, although the present invention was described as applying to toothpaste materials and toothpaste containers, the present invention is not so limited. Instead, the present invention may be applied to other types of materials and containers for storing the same.

Although preferred embodiments of the present invention and modifications thereof have been described in detail herein, it is to be understood that this invention is not limited to these embodiments and modifications, and that other modifications and variations may be effected by one skilled in the art without departing from the spirit and scope of the invention as defined by the appended claims.

What is claimed is:

1. A nozzle apparatus for use with a device for inserting toothpaste having a plurality of materials into a toothpaste container, said apparatus comprising:

a first hollow member for receiving a first material; and a second hollow member arranged inside said first hollow member and having a first end for receiving a second material, in which said second hollow member has openings only at the first and second ends;

said first and second hollow members enabling said first and second materials to be inserted into said toothpaste container so as to have a cross-section arrangement therein resembling two substantially concentric circles such that one of said first and second materials is arranged inside the other of said first and second materials when said toothpaste is dispensed from said toothpaste container.

2. A nozzle apparatus according to claim 1, wherein said first material has a first color and said second material has a second color.

3. A nozzle apparatus according to claim 2, wherein one of said first and second materials is a red-colored gel material and the other of said first and second materials is a white-colored paste material.

4. A nozzle apparatus according to claim 1, further comprising means for stopping the insertion of said toothpaste into said toothpaste container.

5. A nozzle apparatus for use with a device for inserting toothpaste having a plurality of materials into a toothpaste container, said apparatus comprising:

first receiving means for receiving a first material; and second receiving means arranged inside said first means and having a first end for receiving a second material and a second end for outputting the received second material, in which said second receiving means has openings only at the first and second ends;

said first and second receiving means enabling said first and second materials to be inserted into said toothpaste container so as to have a cross-section arrangement therein resembling two substantially concentric circles such that one of said first and second material is arranged inside the other of said first and second materials when said toothpaste is dispensed from said toothpaste container.

6. A nozzle apparatus according to claim 5, wherein said first material has a first color and said second material has a second color.

7. A nozzle apparatus according to claim 6, wherein one of said first and second materials is a red-colored gel material and the other of said first and second materials is a white-colored paste material.

8. A nozzle apparatus according to claim 5, further comprising means for stopping the insertion of said toothpaste into said toothpaste container.

9. A nozzle apparatus for use with a device for inserting a substance having a plurality of materials into a container, said apparatus comprising:

first receiving means for receiving a first material; and second receiving means arranged inside said first means and having a first end for receiving a second material and a second end for outputting the received second material, in which said second receiving means has openings only at the first and second ends;

said first and second receiving means enabling said first and second materials to be inserted into said container so as to have a cross-section arrangement therein resembling two substantially concentric circles such that one of said first and second material is arranged inside the other of said first and second materials when said substance is dispensed from said container.

10. An apparatus for inserting toothpaste having a plurality of materials into a toothpaste container, said apparatus comprising:

means for receiving said plurality of materials; and a nozzle having a first tube member supplied with a first received material, and a second tube member arranged inside said first tube member and having a first end whereat a second received material is supplied and a second end for outputting the second received material, in which said second tube member has openings only at the first and second ends;

said first and second tube members enabling said first and second materials to be inserted into said toothpaste container so as to have a cross-section arrangement therein resembling two substantially concentric circles such that one of said first and second material is arranged inside the other of said first and second materials when said toothpaste is dispensed from said toothpaste container.

11. An apparatus according to claim 10, wherein said first material has a first color and said second material has a second color.

12. An apparatus according to claim 11, wherein one of said first and second materials is a red-colored gel material and the other of said first and second materials is a white-colored paste material.

13. A container having first and second materials stored therein so as to have a cross-section arrangement therein resembling two substantially concentric circles such that one of said first and second material is arranged inside the other of said first and second materials and such that the inner one of said first and second materials is inside the other when the materials are dispensed from the container, wherein said first and second materials are inserted into said container by use of an inserting apparatus having a nozzle which includes a first member for receiving said first material, and a second member arranged inside said first member for receiving said second material.

* * * * *